US008831459B2

(12) United States Patent
Fukui

(10) Patent No.: US 8,831,459 B2
(45) Date of Patent: Sep. 9, 2014

(54) PRINTING APPARATUS, CONTROL METHOD THEREFOR AND PROGRAM FOR SAME

(75) Inventor: Akitomo Fukui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 682 days.

(21) Appl. No.: 13/025,643

(22) Filed: Feb. 11, 2011

(65) Prior Publication Data

US 2011/0200364 A1 Aug. 18, 2011

(30) Foreign Application Priority Data

Feb. 17, 2010 (JP) ..... 2010-032697

(51) Int. Cl.
*G03G 15/00* (2006.01)

(52) U.S. Cl.
CPC ..... *G03G 15/50* (2013.01); *G03G 15/502* (2013.01)
USPC ..... 399/85; 399/87; 399/119; 399/258

(58) Field of Classification Search
CPC ..... G03G 15/5079; G03G 15/5083; G03G 15/5091; G06F 3/1237
USPC ..... 399/85, 87
See application file for complete search history.

(56) References Cited

U.S. PATENT DOCUMENTS

| | | | | |
|---|---|---|---|---|
| 5,809,370 | A | 9/1998 | Ueno | |
| 5,862,430 | A | 1/1999 | Mitekura et al. | |
| 5,887,217 | A | 3/1999 | Mitekura et al. | |
| 6,325,479 | B1 | 12/2001 | Nakamura et al. | |
| 6,718,422 | B1 * | 4/2004 | Kelley et al. | 710/309 |
| 6,850,716 | B2 * | 2/2005 | Kurihara | 399/27 |
| 7,283,258 | B1 | 10/2007 | Kuno et al. | |
| 8,054,494 | B2 * | 11/2011 | Takahashi et al. | 358/1.15 |
| 2004/0051891 | A1 * | 3/2004 | Moro et al. | 358/1.9 |
| 2012/0070167 | A1 * | 3/2012 | Oya | 399/28 |
| 2012/0086955 | A1 * | 4/2012 | Nagai | 358/1.2 |
| 2013/0057913 | A1 * | 3/2013 | Park | 358/1.15 |

FOREIGN PATENT DOCUMENTS

| | | | |
|---|---|---|---|
| CN | 1707418 | A | 12/2005 |
| CN | 101634821 | A | 1/2010 |
| JP | 6143757 | A | 5/1994 |
| JP | 8-238781 | A | 9/1996 |

(Continued)

OTHER PUBLICATIONS

English machine translation of Japanese patent document Torigoe (JP 2005-117087 A); "Printer"; Torigoe, Yusuke; published Apr. 28, 2005.*

*Primary Examiner* — David Gray
*Assistant Examiner* — Geoffrey Evans
(74) *Attorney, Agent, or Firm* — Canon USA Inc. IP Division

(57) ABSTRACT

A printing apparatus that executes printing by using a recording material includes an accepting unit which accepts an instruction from a user, a receiving unit which receives a command from an external device, a first shifting unit to shift the printing apparatus to a state in which the user can supply the recording material according to the instruction accepted by the accepting unit, and a second shifting unit configured to shift the printing apparatus to a state in which the user can supply the recording material according to the command received by the receiving unit. In a case where the printing apparatus is shifted by one of the first shifting unit and the second shifting unit, the printing apparatus is no longer shifted by the other one of the first shifting unit and the second shifting unit.

12 Claims, 7 Drawing Sheets

(56) References Cited

FOREIGN PATENT DOCUMENTS

| | | | |
|---|---|---|---|
| JP | 9-185253 | A | 7/1997 |
| JP | 10-078740 | A | 3/1998 |
| JP | 2005070862 | A | 3/2005 |
| JP | 2005-117087 | A | 4/2005 |
| JP | 2006162811 | A | 6/2006 |
| JP | 2006190073 | A | 7/2006 |
| JP | 2006244246 | A | 9/2006 |
| JP | 2007-087404 | A | 4/2007 |

* cited by examiner

PRINTING APPARATUS, CONTROL METHOD THEREFOR AND PROGRAM FOR SAME

BACKGROUND OF THE INVENTION

1. Field of the Invention

The present invention relates to a printing apparatus and a method for controlling the printing apparatus; more specifically, the present invention relates to a printing apparatus that uses a recording material and that can be shifted to a state where a user can supply the recording material.

2. Description of the Related Art

A printing apparatus that that automatically detects shortage of recording material and prompts a user to replenish the recording material such as toner or in ink is known. Japanese Patent Laid-open Publication No. 09-185253 discloses a conventional printing apparatus that causes a toner storage container to automatically move to an exchange position when the printing apparatus detects a toner end during printing or after printing.

On the other hand, Japanese Patent Laid-open Publication No. 10-078740 discloses a printing apparatus that is shifted to a cartridge exchange mode when the printing apparatus detects a user opening a toner cartridge door. Alternatively, Japanese Patent Laid-open Publication No. 08-238781 discloses a printing apparatus that is shifted to an exchange mode when the printing apparatus receives an instruction of an "ink exchange" through a menu displayed on a host device.

When the user replenishes the recording material of a printing apparatus, no conflict of operations for replenishing the recording material has occurred conventionally between a plurality of users. However, when the operations relating to the replenishment of the recording material can be performed according to both of a command received from an external device and a user instruction issued through an operation panel or the like, there is a case where different operations are performed according to each of the command and the instruction and therefore there is the possibility that the replenishment may be unnecessarily repeated. Further, in a case where the operation relating to the replenishment of the recording material can be performed according to a command from each of a plurality of external devices, the replenishment may not be performed smoothly because the respective commands request different operations.

When a user attempts to use a printing apparatus, and if the printing apparatus is short on the recording material, the user has to replenish the recording material. However, when the user attempts to use the printing apparatus after replenishment of the recording material, other user may start using the printing apparatus. In this case, the user who replenished the recording material himself cannot use the printing apparatus immediately after the replenishment of the recording material and the user has to wait for the other user to finish using the printing apparatus.

SUMMARY OF THE INVENTION

According to an aspect of the present invention, a printing apparatus for executing printing by using a recording material includes an accepting unit configured to accept an instruction from a user, a receiving unit configured to receive a command from an external device, a first shifting unit configured to shift the printing apparatus to a state in which the user can supply the recording material according to the instruction accepted by the accepting unit, and a second shifting unit configured to shift the printing apparatus to a state in which the user can supply the recording material according to the command received by the receiving unit. In a case where the printing apparatus is shifted to the above state according to one of the first shifting unit and the second shifting unit, the printing apparatus is no longer shifted to the above state according to the other one of the first shifting unit and the second shifting unit.

According to another aspect of the present invention, a printing apparatus for executing printing by using a recording material includes a receiving unit configured to receive a command from each of a plurality of external devices and, a shifting unit configured to shift the printing apparatus to a state in which a user can supply the recording material according to the command received by the receiving unit. In a case where the printing apparatus is shifted to the state by the shifting unit according to a command from a first external device, the printing apparatus is no longer shifted to the state by the shifting unit according to a command from a second external device.

According to still another aspect of the present invention, a printing apparatus for executing printing by using a recording material includes a receiving unit configured to receive a command from each of a plurality of external devices and identification information related to the command, a storage unit configured to store the identification information received by the receiving unit, a shifting unit configured to shift the printing apparatus to a state in which a user can supply the recording material according to the command received by the receiving unit. A control unit controls, while the printing apparatus is shifted to the state by the shifting unit, the printing apparatus to execute printing based on a print job related to the identification information stored in the storage unit but to execute no printing based on a print job other than the print job related to the identification information stored in the storage unit.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
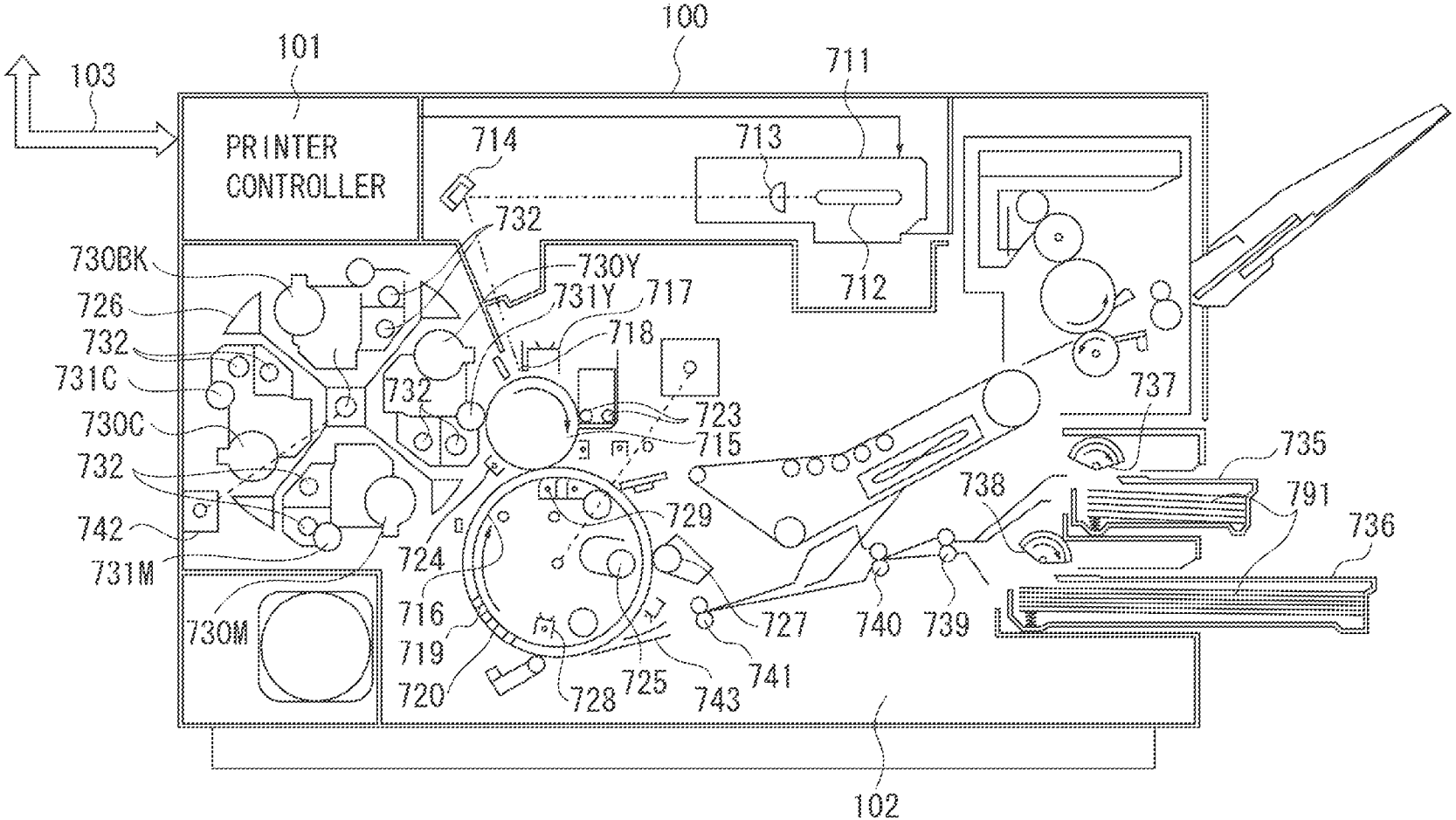
FIG. 1 is a cross sectional view illustrating a configuration of a printing apparatus to which the present invention is applicable.

FIG. 1 is a cross sectional view illustrating a configuration of a printing apparatus to which the present invention is applicable. In FIG. 1, a laser beam printer is exemplified as the printing apparatus. A printing apparatus 100 includes a printer controller 101 and a print unit 102. The printer controller 101 controls an operation of the printing apparatus 100 and communicates with an external device via a communication link 103.

The printing apparatus 100 has a toner cartridge exchange mode in which a toner cartridge is exchangeable (hereinafter referred to as the "exchange mode"). In a case where the printing apparatus 100 is shifted to the exchange mode, the user can exchange the toner cartridge. The printing apparatus that performs printing by using a toner is exemplified below. However, in a case where the printing apparatus is shifted to a state in which the printing apparatus can receive exchange of recording material the present invention can be applicable to a printing apparatus that performs printing by using any recording material that requires replenishment be it ink, toner or the like. For example, the present invention is also applicable to a printing apparatus in a case where the recording material is replenished according to a method other than exchange of the toner cartridge. Examples of the other methods include an exchange of an ink cartridge, an exchange of an ink tank, and filling of a toner by using a toner bottle.

The communication link 103 may be anything as far as that can establish a communication between the printing apparatus 100 and an external device 210. More specifically, the communication link 103 may be a Universal Serial Bus (USB) or a Local Area Network (LAN). The LAN is used in this exemplary embodiment.

The print unit 102 has a configuration as described below.

A scanner 711 includes a laser output unit (not illustrated) for converting an image signal from a printer controller 101 into a light signal (i.e., a laser light), an octahedron polygonal mirror 712, a motor (not illustrated) for rotating the polygonal mirror 712, a f/θ lens (i.e., imaging lens) 713, and the others. The laser light emitted from a laser output unit is reflected on one of side surfaces of the polygonal mirror 712 and goes through the f/θ lens 713 and the reflection mirror 714 to linearly scan (i.e., raster-scan) a surface of a photosensitive drum 715. The photosensitive drum 715 is rotated in an arrow direction as illustrated in FIG. 1. Accordingly, an electrostatic latent image corresponding to an image represented by the image signal is formed on a surface of the photosensitive drum 715. A primary charging device 717, a whole-area exposure lamp 718, a cleaner unit 723 for collecting a toner that was not transferred to a sheet (i.e., a residual toner), a pre-transfer charging device 724, and the like are arranged around the photosensitive drum 715.

A development unit 726 is a unit for developing an electrostatic latent image formed on the surface of the photosensitive drum 715. A configuration of the development unit 726 is described below.

Each of toner cartridges 730Y, 730M, 730C, and 730BK holds therein a toner as a developer material. Each of screws 732 transfers a developer stored in each of the toner cartridges 730Y, 730M, 730C, and 730BK to each of the corresponding developing sleeves 731Y, 731M, 731C, and 731BK. Each of the corresponding developing sleeves 731Y, 731M, 731C, and 731BK are brought into contact with a photosensitive drum 715 to perform development by using the developer. In other words, by using the developer of each of a yellow toner, a magenta toner, a cyan toner, and a black toner, toner images are formed on the photosensitive drum 715. The toner cartridges, the developing sleeves, and the screws are arranged in the vicinity of a central shaft P of the development unit 726. A symbol attached to each of the elements, i.e., Y, M, C, and BK, represents a color different from each other. More specifically, Y represents a yellow color, M represents a magenta color, C represents a cyan color, and BK represents a black color, respectively.

A position sensor 742 detects a rotation position of the development unit 726. When a yellow toner image is formed on the photosensitive drum 715, the development unit 726 is rotated around the shaft P so as to bring the developing sleeve 731Y into contact with the photosensitive drum 715. FIG. 1 illustrates this state. When a magenta toner image is formed, the development unit 726 is rotated around the shaft P so as to bring developing sleeve 731M into contact with the photosensitive drum 715. A cyan toner image and a black toner image can be formed in the same manner as described above.

A transfer drum 716 transfers a toner image formed on the photosensitive drum 715 to a sheet. An actuator board 719 detects a moving position of a transfer drum 716. A position sensor 720 is positioned near the actuator board 719, so that the position sensor 720 detects that the transfer drum is moved to a home position. The actuator board 719, the position sensor 720, a transfer drum cleaner unit 725, a bailing roller 727, and a discharger 729 are included in a transfer charging device and are arranged around the transfer drum 716.

Sheet cassettes 735 and 736 each stores sheets 791. For example, the sheet cassette 735 stores A4-size sheets and the sheet cassette 736 stores A3-size sheets, respectively. When the sheets are supplied or conveyed, paper rollers 737 and 738 assist in supplying sheets from the sheet cassettes 735 and 736, respectively. Timing rollers 739, 740, and 741 control timings for supplying and conveying sheets, respectively. Each of the sheets is guided by a sheet guide 743 through the timing rollers 739, 740 and 741. While a leading end of the sheet is carried by a gripper 728, the sheet wraps around the transfer drum 716. Whether to select the sheet cassette 735 or the sheet cassette 736 is determined by an instruction of a printer controller 101 and only the paper roller corresponding to thus selected sheet cassette is rotated.

With the above described configuration, a full-color printing according to four colors, i.e., according to a combination of Y color, M color, C color, and BK color, is realized.

Figure 2:
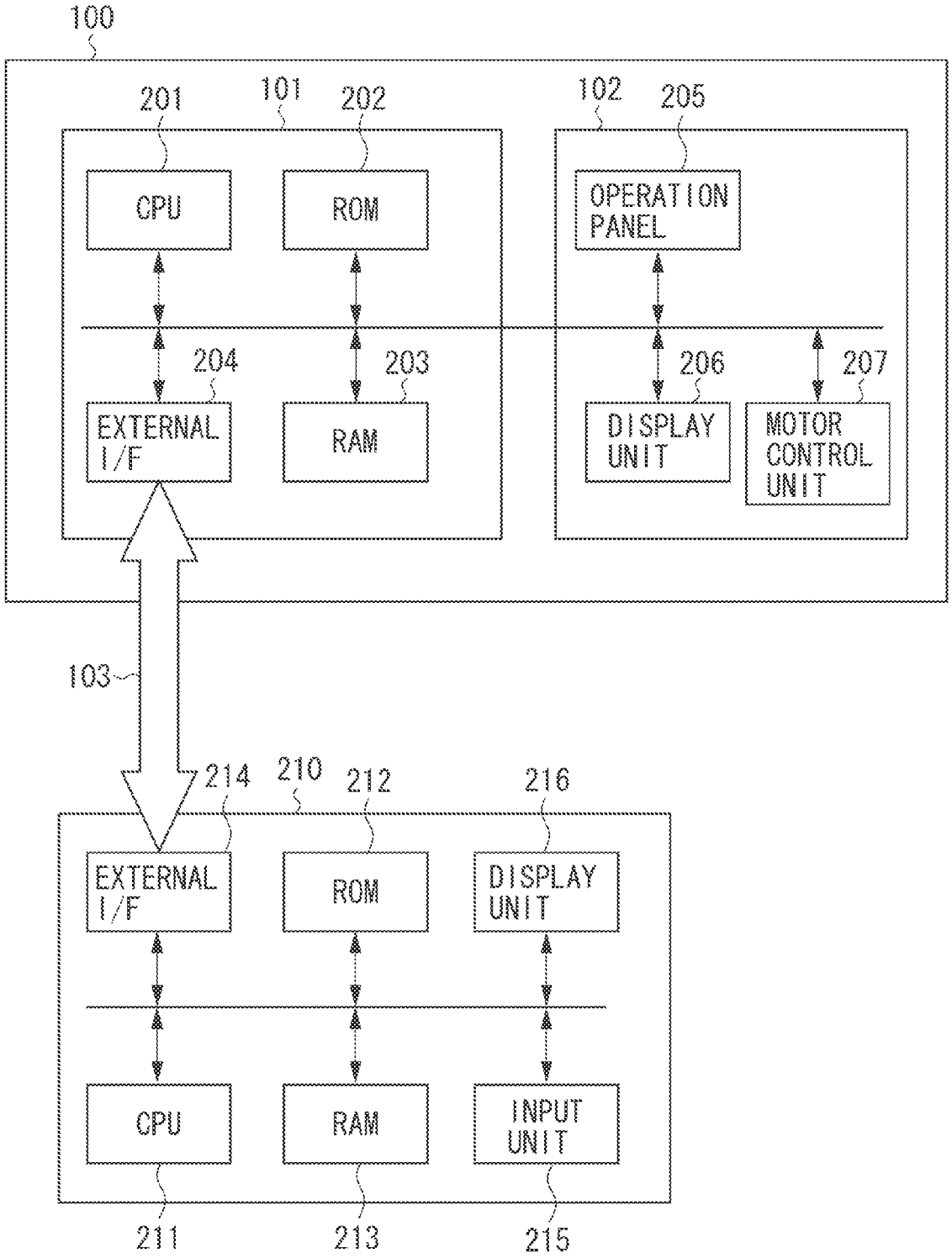
FIG. 2 illustrates a configuration of an external device capable of communicating with a printer controller, a print unit, and the printing apparatus.

FIG. 2 illustrates a configuration of an external device that can communicate with the printer controller 101, the print unit 102, and printing apparatus 100. The configuration of the printing apparatus illustrated in FIG. 1 in the configurations of the printing apparatus 100 is not illustrated in FIG. 2.

The printer controller 101 includes a central processing unit (CPU) 201, a Read-Only Memory (ROM) 202, a Random Access Memory (RAM) 203, and an external interface (I/F) 204. The CPU 201 controls an operation of the printer controller 101 according to a program stored in the ROM 202. The CPU 201 stores various sets of data necessary for print processing in the RAM 203 and controls print processing by using the stored data. Further, the CPU 201 can communicate with the external device 210 via the external I/F 204 and through the communication link 103.

The printer controller 101 rasterizes print data received via the external I/F 204 into image data. The print unit 102 executes printing onto a recording medium based on the image data. The printer controller 101 receives an exchange command, an exchange control command, and other setting commands from the external device 210 via the external I/F 204 which is connected to external devices 210 through communication link 103. The exchange command is transmitted from the external device or devices 210 in order to shift the printing apparatus 100 to an exchange mode. The exchange control command is transmitted from the external device in order to control an exchange of a toner cartridge.

The print unit 102 has a configuration illustrated in FIG. 1 and includes an operation panel 205, a display unit 206, and a motor control unit 207. The operation panel 205 includes a keyboard and a touch panel for accepting an instruction from a user. For example, the operation panel 205 can accept an instruction for shifting the printing apparatus 100 to an exchange mode (i.e., an exchange instruction) and an instruction for controlling the exchange of the toner cartridge (i.e., an exchange control instruction). When the printing apparatus 100 is shifted to the exchange mode, the user can exchange the toner cartridge. The display unit 206 displays a screen for prompting the user to perform a print setting, a screen for accepting the exchange instruction and the exchange control instruction from the user (i.e., a screen for operating the exchange), and a screen for displaying a status of the printing apparatus 100. When the toner cartridge is exchanged, the CPU 201 issues an instruction to a motor control unit 207, and the motor control unit 207 controls the motor according to the instruction so as to move an exchange target toner cartridge to an exchange position.

The external device 210 includes a CPU 211, a ROM 212, a RAM 213, an external I/F 214, an input unit 215, and a display unit 216. An example of the external device 210 includes a personal computer.

The CPU 211 controls an operation of the external device 210 according to a program stored in the ROM 212. The CPU 211 causes the RAM 213 to store therein various sets of data necessary for data processing and controls the data processing by using thus stored data. The CPU 211 can communicate with the printing apparatus 100 via the external I/F 214. Examples of the input unit 215 include a keyboard and a mouse for inputting the instruction from the user. The display unit 216 displays a screen for accepting print settings from the user (i.e., a print setting screen) and a screen for accepting an instruction for shifting the printing apparatus to an exchange mode and an instruction for controlling the exchange of toner cartridge (i.e., an exchange operation screen) from the user.

The external device 210 may be any device as long as the device can transmit print data and various commands to the printing apparatus 100. For example, the external device 210 may be any one of a personal computer (PC), a server computer, a workstation, a scanner device, a multifunction peripheral, a digital camera, a cell-phone, or a Personal Digital Assistant (PDA).

An operation of the printing apparatus 100 is described below.

Figure 7:
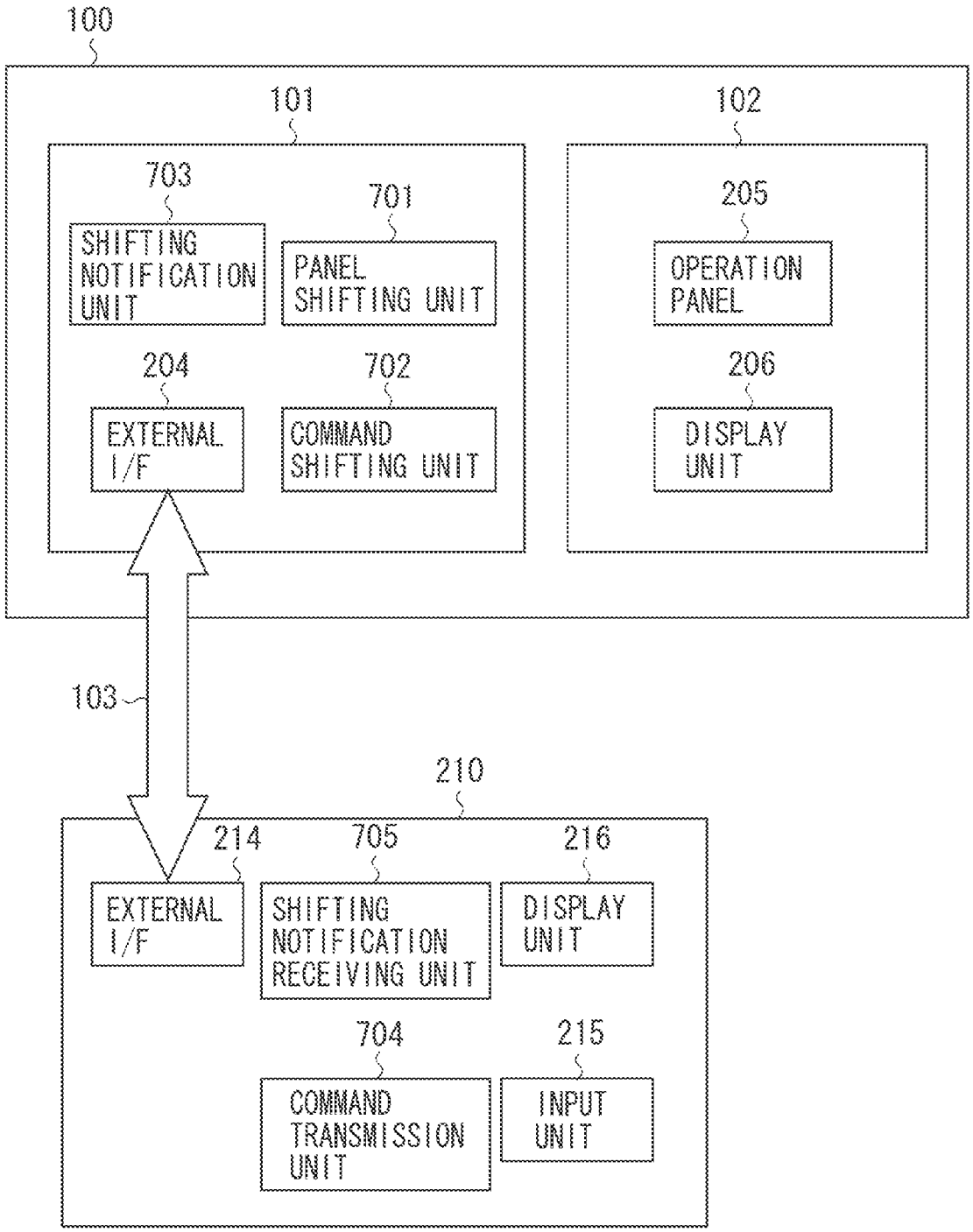
FIG. 7 illustrates a functional configuration of the printing apparatus and the external device.

FIG. 7 illustrates a functional configuration of the printing apparatus 100 and the external device 210. In FIG. 7, the printer controller 101 includes functions in the form of a panel shifting unit 701, a command shifting unit 702, and a shifting notification unit 703. Those functions can be realized by, for example, causing the CPU 201 to execute the program stored in the ROM 202. An external device 210 includes functions in the form of a command transmission unit 704 and a shifting notification receiving unit 705. The functions are realized by, for example, causing the CPU 211 (FIG. 2) to execute the program stored in the ROM 212. FIG. 7 mainly illustrates a function relating to the exchange of the toner cartridge. The printer controller 101 and the external device 210 also include functions other than the above.

The panel shifting unit 701 causes the printing apparatus 100 to shift to the exchange mode according to the change instruction accepted through the operation panel 205. In the exchange mode, the panel shifting unit 701 rotates the toner cartridge around the shaft P to move the toner cartridge to a position where the toner cartridge can be exchanged (i.e., an exchange position). For example, in the illustration of FIG. 1, the exchange position of the toner cartridge corresponds to a position shown to be that of the toner cartridge 730C. The exchange position of the toner cartridge is not limited to the example of FIG. 1 but can be different according to the configuration of the printing apparatus. The panel shifting unit 701 manages a status of the printing apparatus 100 in a case where the printing apparatus 100 is shifted to the exchange mode according to the operation panel 205. Examples of the statuses of the panel shifting unit 701 include three statuses, i.e., "shifting request was made", "shifting was completed", and "no shifting request was made". When the panel shifting unit 701 receives the exchange instruction from the operation panel 205, a status of the panel shifting unit 701 becomes "shifting request was made". When the state of the panel shifting unit 701 becomes active, the status of the shifting unit 701 becomes "shifting was completed". When there is no exchange instruction, the status of the panel shifting unit 701 becomes "no shifting request was made".

The command shifting unit 702 shifts the printing apparatus 100 to the exchange mode according to the exchange command received via the external I/F 204. The command shifting unit 702 also manages the status of the printing apparatus 100 in a case where the printing apparatus 100 is shifted to the exchange mode according to the exchange command. Examples of the statuses of the command shifting unit 702 include three statuses, i.e., "shifting request was made", "shifting was completed", and "no shifting request was made". When the command shifting unit 702 receives the exchange command from the external I/F 204, the status of the command shifting unit 702 becomes "shifting request was made". Also, when the state of the command shifting unit 702 becomes active, the status of the command shifting unit 702 becomes "shifting was completed". When there is no exchange command, the status of the command shifting unit 702 becomes "no shifting request was made".

In a case where the panel shifting unit 701 is in the status of the "shifting request was made" or the "shifting was completed", the shifting notification unit 703 transmits information indicating that the printing apparatus 100 is in a state of shifting to the exchange mode, through the operation panel 205 to the external device via the external I/F 204. The shifting notification unit 703 also causes the display unit 206 to display a message indicating that the printing apparatus 100 is in the state of shifting to the exchange mode.

On the other hand, in a case where the command shifting unit 702 is in the status of "shifting request was made" or "shifting was completed", the shifting notification unit 703 transmits the information indicating that the printing apparatus 100 is in a state of shifting to the exchange mode according to the exchange command, to the external device via the external I/F 204. The shifting notification unit 703 also causes the display unit 206 to display a message indicating that the printing apparatus 100 is in a state of shifting to the exchange mode according to the exchange command.

A command transmission unit 704 generates a print command, an exchange command, an exchange control command, and the other setting commands according to an instruction input through the input unit 215 by the user and outputs those commands to the printing apparatus 100 via the external I/F 214. A command transmission unit 704 may be configured in any form as long as the command transmission unit 704 can generate and transmit a command for controlling the printing apparatus 100 according to the instruction from the user. More specifically, the command transmission unit 704 may be provided within printer driver software or may be provided within an application tool. The command transmission unit 704 is provided within the application tool in the present case.

A shifting notification receiving unit 705 receives information indicating that the printing apparatus 100 is in a state of shifting to the exchange mode, from the printing apparatus 100 via the external I/F 214. Upon receiving the information, the shifting notification receiving unit 705 causes the display unit 216 to display a message indicating that the printing apparatus 100 is in a state of shifting to the exchange mode. In a case where the printing apparatus 100 is in a state of shifting to the exchange mode according to the exchange instruction or the exchange command from the other external device, the shifting notification receiving unit 705 controls the display unit 216 such that a menu for calling up a screen for operating the exchange of the toner cartridge is gray out. In other words, the shifting notification receiving unit 705 controls such that no exchange instruction can be input through the input unit 215.

Figure 3:
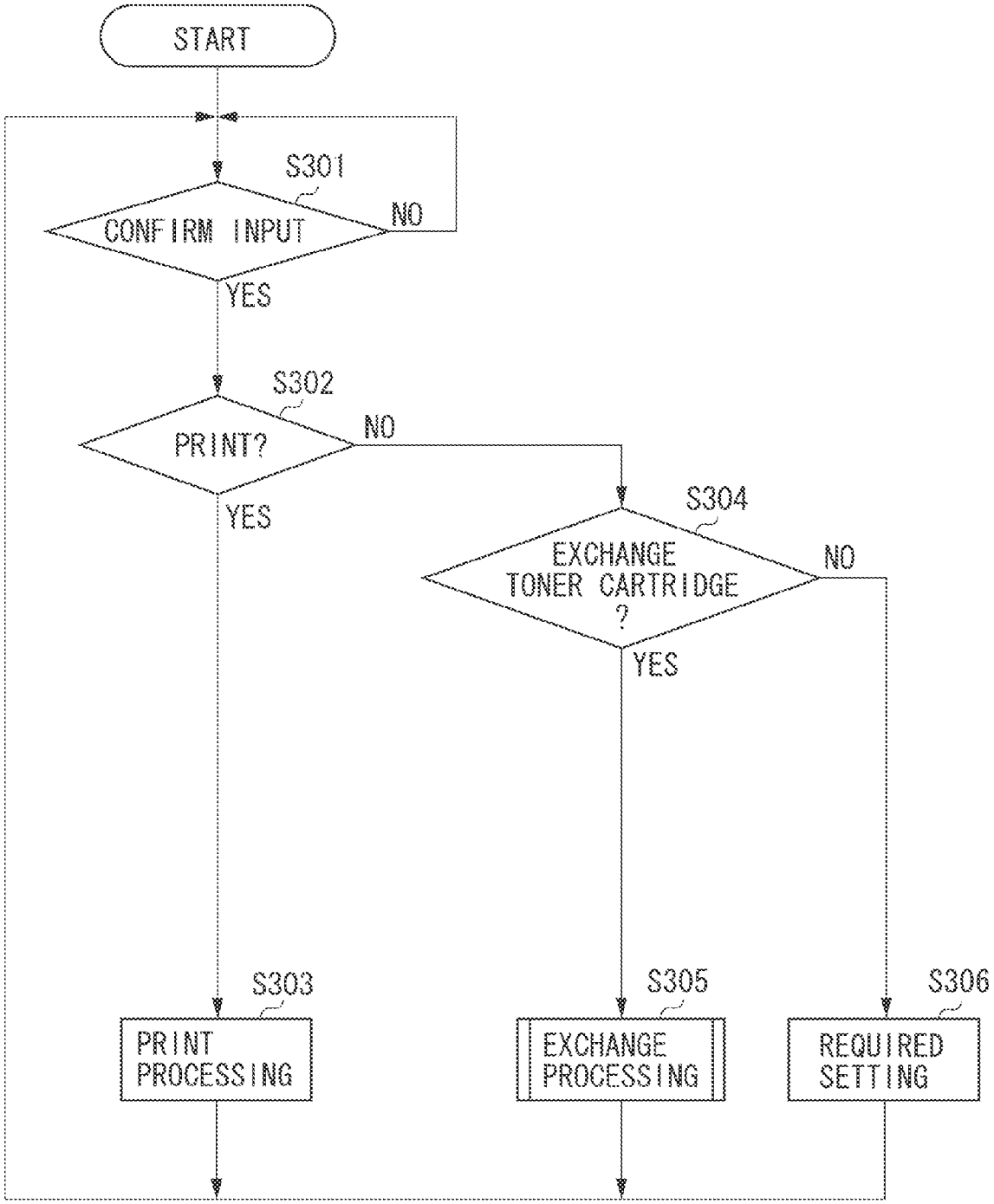
FIG. 3 is a flow chart illustrating a main operation of the printing apparatus.

FIG. 3 is a flow chart illustrating a main operation of the printing apparatus 100.

The printing apparatus 100 executes an initialization upon power-on of a power source. After the initialization, the printing apparatus 100 is shifted to a stand-by state in order to wait for an input of some instruction or command. In S301, the printer controller 101 determines whether or not any instruction or command is input through the external I/F 204 or the operation panel 205.

In step S302, upon receiving the instruction or the command (YES in step S301), the printer controller 101 determines whether the instruction or the command is a print instruction or a print command.

In a case where the printing apparatus 100 executes print processing based on print data from the external device 210, the printing apparatus 100 receives the print command via the external I/F 204. In a case where the printing apparatus 100 includes a storage unit (not illustrated) for storing image data and executes the print processing based on the image data stored in the storage unit, the printing apparatus 100 receives the print instruction that instructs printing of the image data via the operation panel 205. Alternatively, the printing apparatus 100 receives the print command that instructs printing of the image data stored in the storage unit via the external I/F 204. Further, in a case where the printing apparatus 100 includes a scanner device (not illustrated) and executes print processing based on the image data read out by the scanner device, the printing apparatus 100 receives a print instruction via the operation panel 205.

In step S303, in a case where thus input instruction or command is the print instruction or the print command (YES in step S302), the printer controller 101 executes the print processing to cause the print unit 102 to perform printing based on the image data.

In step S304, in a case where the thus input instruction or command is not a "print" instruction or a print command (NO in step S302), the printer controller 101 determines whether the instruction or the command is an "exchange" instruction or exchange command. In step S305, in a case where thus input instruction or command is the exchange instruction or the exchange command (YES in step S304), the printer controller 101 executes the exchange processing. How to execute the exchange processing is described below.

In step S306, in a case where thus input command is not the exchange instruction or the exchange command (NO in step S304), the printer controller 101 performs various settings according to a content of the instruction or the command. Alternatively, in a case where the content of the instruction or the command is to obtain a status, the printer controller 101 obtains a status of the printing apparatus 100 and notifies the status information to the external device 210 or displays the status information on the display unit 206.

Figure 4:
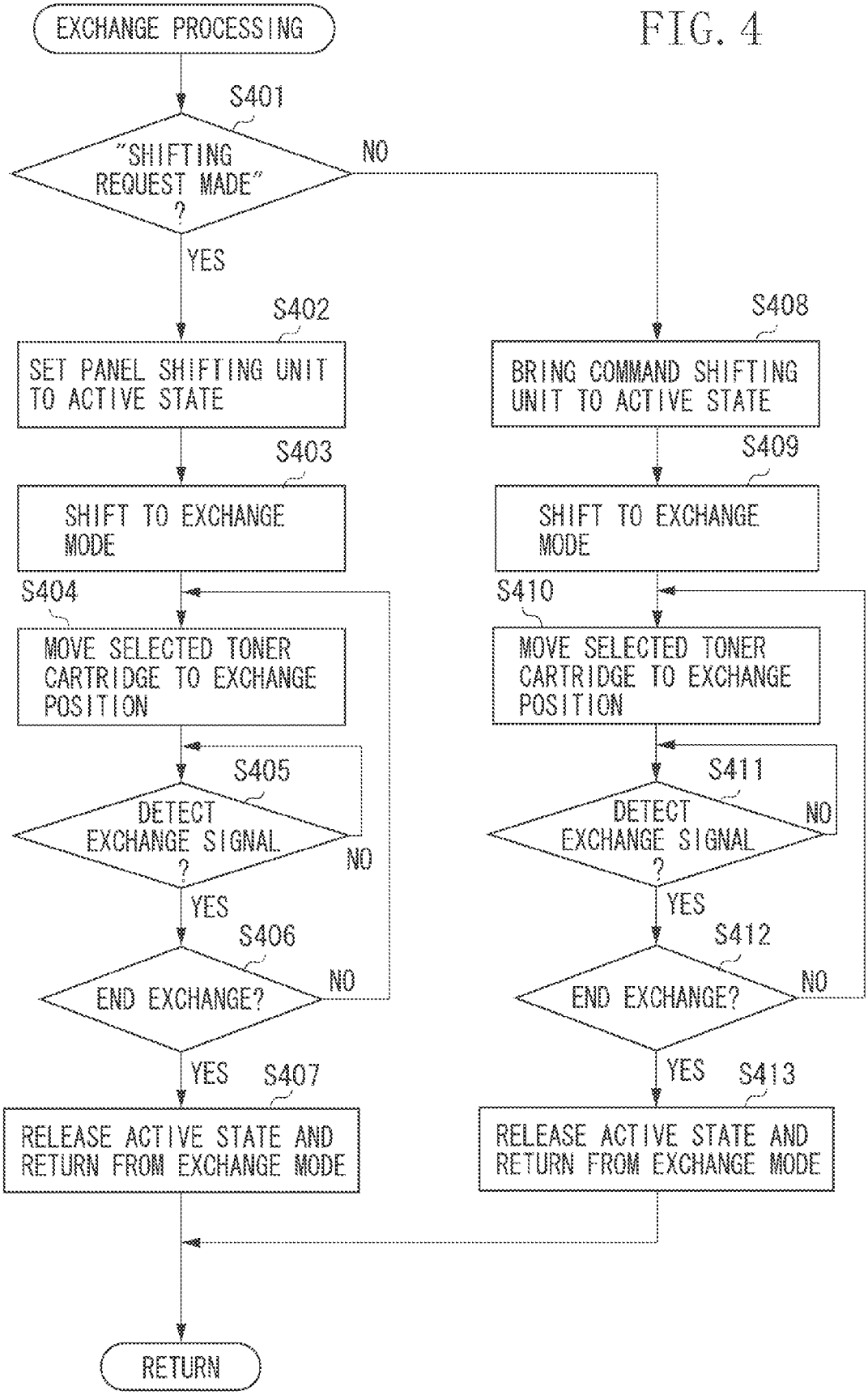
FIG. 4 is a flow chart illustrating exchange processing.

Now, an exchange operation is described below. FIG. 4 is a flow chart illustrating the exchange processing performed in S305.

The printer controller 101 determines whether the exchange command is input from the external I/F 204 or whether the exchange instruction is input from the operation panel 205. In step S401, the printer controller 101 confirms the status of the panel shifting unit 701 and determines if a panel shifting unit 701 is in the status of "shifting request was made".

In step S402, in a case where the panel shifting unit 701 is in the status of "shifting request was made" (YES in step S401), the printer controller 101 enters the shifting to the exchange mode through the operation panel 205 and causes the panel shifting unit 701 to be in the active state. The active state here means that the printer controller 101 keeps the panel shifting unit 701 in the status of "shifting was completed" until the exchange of the toner cartridge is completed. The active state of the panel shifting unit 701 causes the panel shifting unit 701 to be in the status of "shifting was completed". In this state, when the shifting notification unit 703 receives the exchange command, the print command, or the other setting commands from the external device 210 via the external I/F 204, the shifting notification unit 703 notifies the external device 210 that the printing apparatus 100 is in the state of shifting to the exchange mode through the operation panel 205. The printer controller 101 does not execute any one of the printing according to the print command, the shifting to the exchange mode according to the exchange command, and the various settings according to the setting commands.

In step S403, the panel shifting unit 701 subsequently shifts the printing apparatus 100 to the exchange mode. When the printing apparatus 100 is shifted to the exchange mode, the display unit 206 displays a message indicating that the printing apparatus 100 is in the state of the exchange mode as well as displays the exchange operation screen. When this screen is displayed, various instructions necessary for the exchange operation (i.e., the exchange control instructions) become acceptable by the operation panel 205.

The user selects the toner cartridge to be exchanged in the present case. In step S404, when an instruction to select a certain toner cartridge is input through the operation panel 205, the print unit 102 moves the thus selected toner cartridge to an exchange position.

In step S405, the printer controller 101 determines whether or not the printer controller 101 detects an exchange signal generated by the exchange operation of the user. In a case where the printer controller 101 detects the exchange signal (YES in step S405), the printer controller 101 recognizes that the exchange of the selected toner cartridge is completed. In step S406, the printer controller 101 determines whether an instruction for selecting the other toner cartridge is input through the operation panel 205 or whether an instruction indicative of an end of the exchange is input through the operation panel 205.

In a case where the user does not instruct the end of the exchange of the toner cartridge but instructs the selection of another toner cartridge (NO in S406), the processing returns to step S404. In step S407, in a case where the user instructs the end of the exchange of the toner cartridge (YES in step S406), the printer controller 101 releases the active state of the panel shifting unit 701 and causes the printing apparatus 100 to return from the exchange mode. Because the panel shifting unit 701 is no longer in the active state, the status of the panel shifting unit 701 becomes "no shifting request was made".

In step S408, in a case where the panel shifting unit 701 is not in the status of "shifting request was made" (NO in step S401), the printer controller 101 enters the shifting to the exchange mode according to the exchange command and causes the command shifting unit 702 to be in the active state.

In the present case, the active state is a state that the printer controller 101 allows the command shifting unit 702 to be in the status of "shifting was completed" until the exchange of the toner cartridge is completed. Thus, in the active state, the command shifting unit 702 is in the status of "shifting was completed". In this state, the shifting notification unit 703 causes the display unit 206 to display a message indicating that the printing apparatus 100 is in the state of shifting to the exchange mode according to the exchange command. The shifting notification unit 703 causes the operation panel 205 not to accept the exchange instruction or the print instruction and further causes the display unit 206 not to display the print setting screen or the exchange operation screen. When the shifting notification unit 703 receives the exchange command, the print instruction, and/or the other setting commands from the other external device via the external I/F 204, the shifting notification unit 703 notifies the other external device that the printing apparatus 100 is in the state of shifting to the exchange mode according to the exchange command. The printer controller 101 does not execute anyone of the printing according the print command from the other external device, the shifting to the exchange mode according to the exchange command from the other external device, and the various settings according to the setting commands from the other external device.

In step S409, the command shifting unit 702 causes the printing apparatus 100 to shift to the exchange mode. When the printing apparatus 100 is shifted to the exchange mode, the printer controller 101 accepts a command necessary for exchanging the toner cartridge (i.e., the exchange control command) from the external device 210.

The user selects the exchange target toner cartridge here. In step S410, when the command for selecting a certain toner cartridge is input through the external I/F 204, the print unit 102 causes thus selected toner cartridge to move to the exchange position.

In step S411, the printer controller 101 determines whether or not the exchange signal generated according to the exchange operation by the user is detected. In a case where the printer controller 101 detects the exchange signal (YES in step S411), the printer controller 101 recognizes that the exchange of the selected toner cartridge is completed. In step S412, the printer controller 101 determines whether a command for selecting another toner cartridge is received through the external I/F 204 or whether a command for indicating the end of the exchange of the toner cartridge is received through the external I/F 204.

In a case where the printer controller 101 receives, without receiving the command indicative of the end of the exchange of the toner cartridge, the command indicative of the selection of the other toner cartridge from the external device 210, the processing proceeds to step S410. In step S413, in a case where the printer controller 101 receives the command indicative of the end of the exchange of the toner cartridge from the external device 210 (YES in step S412), the printer controller 101 releases the active state of the command shifting unit 702 and causes the printing apparatus 100 to return from the exchange mode. Because the command shifting unit 702 is no longer in the active state, the command shifting unit 702 is in the status of "no shifting request was made".

As described above, the shifting to the exchange mode according to the exchange instruction from the operation panel 205 and the shifting to the exchange mode according to the exchange command from the external device 210 can be exclusively controlled. Further, the shifting to the exchange mode according to the exchange command from the external device 210 and the shifting to the exchange mode according to the exchange command from the other external device can also be exclusively controlled. In other words, in a case where the printing apparatus 100 is shifted to the exchange mode according to one of the shifting instruction and the shifting command, the printing apparatus 100 is no longer shifted to the exchange mode according to the other one of the shifting instruction and the shifting command.

In a second exemplary embodiment, the external device 210 sends the exchange command after adding information for specifying the external device 210 (i.e., identification information) itself. The information for specifying the external device 210 may be any information as long as the information can identify each of the plurality of external devices. More specifically, the information may be any one of an ID unique to each of the devices, an ID of the user who uses the device, and an ID with respect to processing relating to a series of operations such as a network address or a job of the device. The information is referred to as the ID unique to the device (hereinafter referred to as the "device ID").

Figure 5:
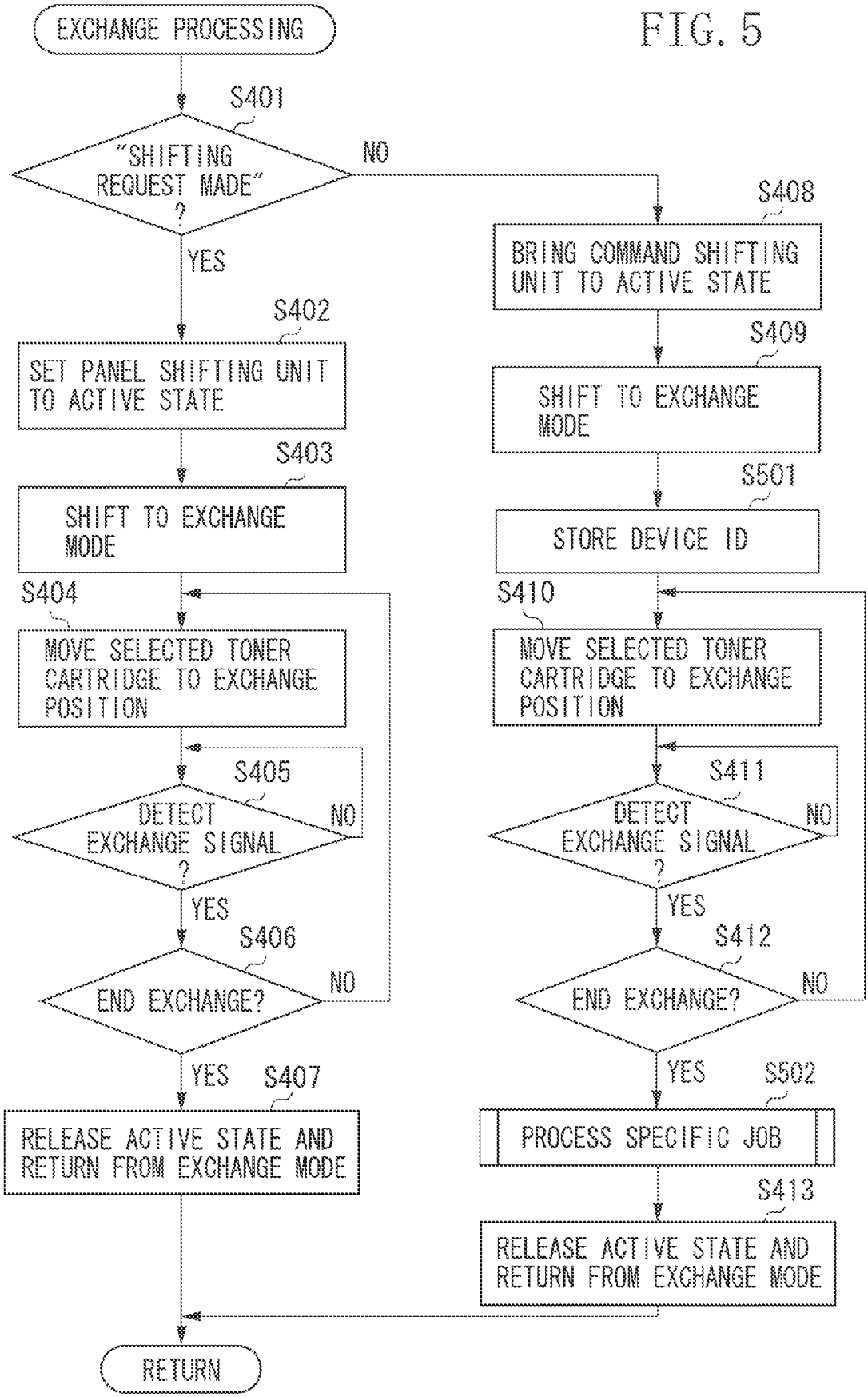
FIG. 5 is a flow chart illustrating exchange processing according to a second exemplary embodiment.

FIG. 5 is a flow chart illustrating exchange processing according to the second exemplary embodiment. In FIG. 5, the steps having the step numbers identical to those illustrated in FIG. 4 are identical to those in FIG. 4.

In FIG. 5, after the step S409, in step S501, the printer controller 101 causes the RAM 203 to store the device ID related to the exchange command in a predetermined area of the RAM 203. On the other hand, the command transmission unit 704 transmits the exchange command to the printing apparatus 100 after adding the device ID to the exchange command.

Figure 6:
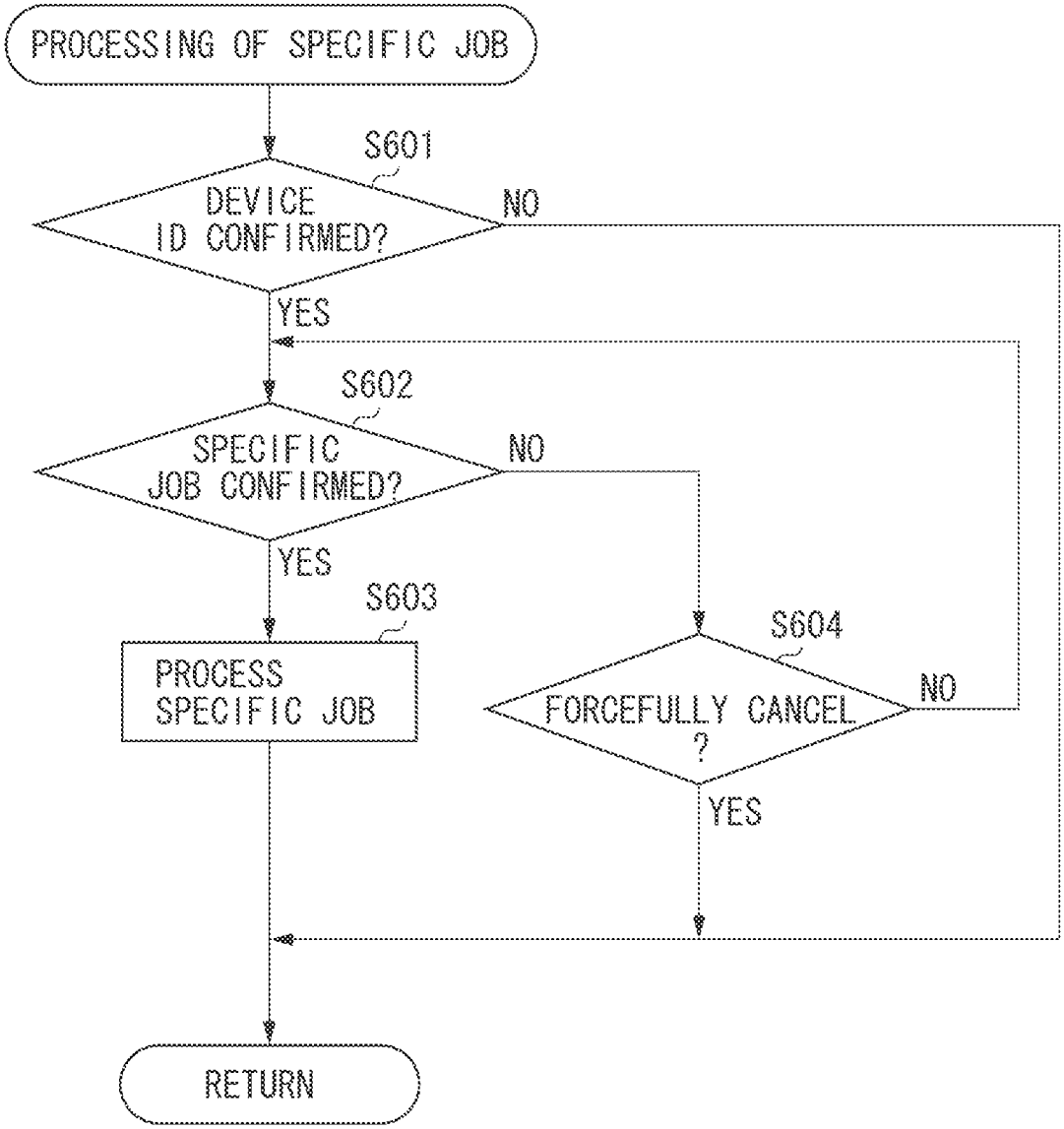
FIG. 6 is a flow chart illustrating how to process a specific job.

In FIG. 5, after the step S412, in step S502, the specific job is processed. FIG. 6 is a flow chart illustrating processing of the specific job.

In step S601, the printer controller 101 determines whether the device ID is stored in the predetermined area of the RAM 203. In a case where the device ID is not stored in the predetermined area of the RAM 203 (NO in step S601), the processing proceeds to step S413 of FIG. 5.

In step S602, in a case where the device ID is stored in the predetermined area of the RAM 203 (YES in step S601), the printer controller 101 determines whether or not a print job is received from the external device 210 corresponding to the device ID. Similar to a case of the exchange command, the device ID is also added to the print job.

In step S603, in a case where the printer controller 101 determines that the print job is received (YES in step S602), the printer controller 101 causes the print unit 102 to execute printing based on the print job. Examples of the print job include printing based on print data and printing based on image data designated by the print command. In a case where the printer controller 101 determines that a print job other than the print job related to the device ID is received, the printer controller 101 does not cause the print unit 102 to execute the printing based on the print job.

In step S604, in a case where the printer controller 101 determines that the print job is not received from the external device 210 corresponding to the device ID (NO in step S602), the printer controller 101 determines whether a command for forcibly releasing the exchange mode is received from the external device 210 corresponding to the device ID. Similar to the case of the exchange command, the device ID is also added to the command for forcibly releasing the exchange mode. In a case where the printer controller 101 determines that the command for forcibly releasing the exchange mode is received (YES in step S604), the processing proceeds to step S413 of FIG. 5. In a case where the printer controller 101 determines that the command for forcibly releasing the exchange mode is not received (NO in step S604), the processing returns to step S602.

In FIGS. 5 and 6, the print job corresponding to the device ID is received from the external device and the print job is executed on a priority basis. However, the print job corresponding to the user ID among a plurality of print jobs stored in the printing apparatus 100 may be executed. In this case, in step S501, the printer controller 101 causes the RAM 203 to store the user ID related to the exchange command or the exchange instruction in a predetermined area of the RAM 203. In step S602, the printer controller 101 determines whether or not the user ID is input through the operation panel 205. In step S603, the printer controller 101 causes the display unit 206 to display a print job or a list of a plurality of print jobs presently stored in the printing apparatus 100 and controls the operation panel 205 such that the instruction for selecting the print job to be printed can be accepted from the user.

Accordingly, the user who exchanged the toner (i.e., the user of the external device 210 in this case) can use the printing apparatus 100 in a priority basis.

Examples of the method for forcibly releasing the exchange mode include accepting the instruction for forcibly releasing the exchange mode through the operation panel 205 and accepting the command for forcibly releasing the exchange mode from the other external device. Accordingly, even in a case where the user of the external device 210 stops transmitting the print job or in a case where it becomes impossible for the user of the external device 210 to transmit the print job for some reason, other users can release the exchange mode.

As is described in the first exemplary embodiment and the second exemplary embodiment, according to the present invention, a conflict between the operations relating to the replenishment of the recording material, that prevents smooth replenishment of the recording material, can be avoided.

Alternatively, according to the present invention, the user who replenished the recording material can use the printing apparatus in a priority basis. Therefore, the user is not kept waiting.

Other Embodiments

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-032697 filed Feb. 17, 2010, which is hereby incorporated by reference herein in its entirety.

What is claimed is:

1. A printing apparatus for executing printing by using a recording material held in a holding unit, the printing apparatus comprising:

an accepting unit configured to accept an instruction from a user;

a receiving unit configured to receive a command from an external device;

a moving unit configured to move the holding unit to a position where the user can supply a recording material;

a first shifting unit configured to shift, according to an instruction via the accepting unit, the printing apparatus to a first state in which the holding unit is moved to the position according to an instruction via the accepting unit; and a second shifting unit configured to shift, according to a command via the receiving unit, the printing apparatus to a second state in which the holding unit is moved to the position according to a command via the receiving unit;

wherein, in the first state, the holding unit is not moved to the position according to a command via the receiving unit, wherein, in the second state, the holding unit is not moved to the position according to an instruction via the accepting unit, and wherein, in a case where the printing apparatus is shifted by one of the first shifting unit and the second shifting unit, the printing apparatus is no longer shifted by the other one of the first shifting unit and the second shifting unit.

2. The printing apparatus according to claim 1, further comprising:

a notification unit configured to notify the external device that the printing apparatus is shifted to the first state in a case where the printing apparatus is shifted to the first state by the first shifting unit.

3. The printing apparatus according to claim 1, further comprising:

a display unit configured to display a message indicating that the printing apparatus is shifted to the second state in a case where the printing apparatus is shifted to the second state by the second shifting unit.

4. The printing apparatus according to claim 1:

wherein the receiving unit receives the command and identification information related to the command;

wherein the printing apparatus comprises a storage unit configured to store the identification information received by the receiving unit; and wherein the printing apparatus executes printing based on a print job related to the identification information stored in the storage unit and executes no printing based on a print job other than the print job related to the identification information stored in the storage unit, while the printing apparatus is in the second state after the holding unit has been exchanged.

5. The printing apparatus according to claim 4:

wherein the printing apparatus is released from the second state according to the accepting unit accepting an instruction for forcibly releasing the second state or according to the receiving unit receiving a command for forcibly releasing the state; and wherein the printing apparatus executes printing based on a print job other than the print job related to the identification information stored in the storage unit after the printing apparatus is released from the second state.

6. The printing apparatus according to claim 1, wherein if the printing apparatus is shifted to the first state by the first shifting unit, the command from the external apparatus to move the holding unit to the position is not executed, and if the printing apparatus is shifted to the second state by the second shifting unit, the instruction from the user to move the holding unit to the position is not executed.

7. The printing apparatus according to claim 1, further comprising:

a plurality of holding units configured to hold the recording material, wherein the moving unit is configured to move one of the plurality of holding units to the position.

8. The printing apparatus according to claim 1, wherein the position is a position in which the holding unit can be exchanged, and the user exchanges the holding unit to supply the recording material.

9. The printing apparatus according to claim 7, wherein the moving unit is configured to rotate the plurality of holding units to move one of the plurality of holding units.

10. The printing apparatus according to claim 1, wherein the recording material is toner, and the holding unit is a toner cartridge.

11. A method for controlling a printing apparatus that executes printing by using a recording material held in a holding unit, the method comprising:

accepting an instruction from a user;

receiving a command from an external device;

first-shifting to cause the printing apparatus to shift to a first state according to the accepted instruction; and second-shifting to cause the printing apparatus to shift to a second state according to the received command, wherein, in the first state, the holding unit is moved to a position where the user can supply a recording material according to an instruction from the user and is not moved to the position according to a command from the external device wherein, in the second state, the holding unit is moved to the position according to a command from the external device and is not moved to the position according to an instruction from the user, and wherein, in a case where the printing apparatus is shifted according to one of the first-shifting and the second-shifting, the printing apparatus is no longer shifted according to the other one of the first-shifting and the second-shifting.

12. A computer readable storage medium storing a program for controlling a printing apparatus that executes printing by using a recording material held in a holding unit, the program including instructions that when executed by a computer cause the computer to execute:

accepting an instruction from a user;

receiving a command from an external device;

first-shifting to cause the printing apparatus to shift to a first state according to the accepted instruction; and second-shifting to cause the printing apparatus to shift to a second state according to the received command, wherein, in the first state, the holding unit is moved to a position where the user can supply a recording material according to an instruction from the user and is not moved to the position according to a command from the external device, wherein, in the second state, the holding unit is moved to the position according to a command from the external device and is not moved to the position according to an instruction from the user, and wherein, in a case where the printing apparatus is shifted according to one of the first-shifting and the second-shifting, the printing apparatus is no longer shifted according to the other one of the first-shifting and the second-shifting.

* * * * *